US006305615B1

(12) United States Patent
Traktovenko

(10) Patent No.: US 6,305,615 B1
(45) Date of Patent: Oct. 23, 2001

(54) RAIL CLIP

(75) Inventor: Boris G. Traktovenko, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/640,161

(22) Filed: Aug. 16, 2000

(51) Int. Cl.[7] ..... E01B 13/00; B66B 7/02
(52) U.S. Cl. ..... 238/315; 238/336; 187/408
(58) Field of Search ..... 238/310, 315, 238/319, 321, 329, 331, 332, 333, 334, 336, 338, 343, 355; 187/406, 408

(56) References Cited

U.S. PATENT DOCUMENTS 2,051,982 * 8/1936 Boyd et al. ..... 238/315
4,324,360 4/1982 Sun et al. ..... 238/349
5,135,165 * 8/1992 Greenhow ..... 238/341

* cited by examiner

*Primary Examiner*—S. Joseph Morano
*Assistant Examiner*—Robert J. McCarry, Jr.

(57) ABSTRACT

A rail clip that is generally symmetrical about a central axis. The clip has an L-shaped base section having a horizontal leg that is securable to a support member upon which the rail rest and a vertical leg that extends upwardly from the base adjacent to the rail. An arm extends outwardly over the rail from the vertical leg of the base section and an elongated beam is mounted in the distal end of the arm that extends outwardly to either side of the arm so that beams run longitudinally along the rail. A contact pad is carried on both ends of the beam which normally rest in holding contact against the rail. As the rail is displaced upwardly in reference to the arm, second contact points are established to progressively stiffen the clip.

12 Claims, 4 Drawing Sheets

RAIL CLIP

FIELD OF THE INVENTION

This invention relates generally to a rail clip, and specifically to a rail clip that is ideally suited for use in securing the guide rails of an elevator system to underlying support brackets.

BACKGROUND OF THE INVENTION

In traction elevator systems the elevator cab is connected to a counterweight unit by hoist ropes and a sheave or pulley system. The cab and the counterweight unit are each typically mounted between a pair of vertically extended guide rails and are arranged to ride along the rails upon rollers or guide shoes. The guide rails are generally T-shaped sections that are normally erected in sixteen foot lengths and are attached to the building housing the elevator system by support brackets.

In assembly, the base flange of the T-shaped vertical sections are attached to support brackets by clips so that the blade or web section of each rail points inwardly towards the cab or the counterweight unit as the case may be. The guide roller or shoes ride along the blades along with the safeties which are designed to apply a sufficient frictionally holding force against the rails to bring the cab to a rapid and safe stop in the event an overspeed condition is sensed. As can be seen, the rail sections must be precisely aligned in assembly because they determine the positioning of the elevator in the hoistway and the related positioning of much of the operating equipment.

The clips used to mount the rail sections to the support brackets must permit the rail sections to shift or move longitudinally in the event the building housing the elevator system settles or the support brackets and/or the building to which the brackets are attached deform non-uniformly due to thermal stresses. The requirements for rail clips are thus not necessarily mutually compatible. The clips must, on one hand, provide sufficient hold force to support the rail weight plus the dynamic load produced by a car moving over the rail and the car during safety engagements. On the other hand, the clips must allow the rail to slide vertically in the event the building housing the elevator system settles or there is a difference in thermal expansion between the building and the rails. This requires that the clamping force exerted by the clips must be within a certain predetermined range. A change in the lateral distance between the support bracket and the contact point, due to rail tolerances or a rust build-up under the rail, will effect preload force moving the force outside the predetermined range. This can, in turn, cause the rail to buckle, thus adversely effecting the smoothness of the ride as the cab moves over the rails. Accordingly, the clips must be soft enough under normal conditions to accommodate the change in the lateral distance between the support bracket and the contact point without significant change in a clamping force, yet stiff enough to resist lateral displacement of the rails under excessive lateral displacement.

The disadvantage of a soft clip is that although they accommodate a rust build up under the rail or variation in the rail tolerances without substantial change in clamping force, it generally cannot meet the code requirements for seismic applications. On the other hand, for rigid seismic clips, any such change in lateral displacement can dramatically increase the holding force that the clip exerts on the rail and thus adversely effect the rail's ability to slide longitudinally.

SUMMARY OF THE INVENTION

It is therefore an object of the present invention to improve clips for holding the elevator guide rail sections to support brackets.

It is a further object of the present invention to provide an elevator rail clip that increases its effective stiffness as the lateral displacement of the rail beneath the clip increases.

Another object of the present invention is to provide a rail clip that exhibits a soft response to small changes in the lateral displacement of the rail beneath this clip and increases its effective stiffness in response to increases in the lateral displacement of the rail beneath the clip.

A still further object of the present invention is to provide an elevator guide rail clip that will accommodate a normal rust build up beneath the rail sections without producing an appreciable change in the clip's effective clamping force.

These and other objects of the present invention are attained by a rail clip that is ideally suited for use in securing T-shaped elevator guide rail sections to underlying support brackets. The clip is generally symmetrical about a central axis and includes a base section that can be secured to a support bracket adjacent to the base flange of a rail. An arm extends outwardly over the base flange of the rail which has a flat lower surface that is in parallel alignment with the support surface of the bracket. A pair of wings extend outwardly from opposed side walls of the arm and slope downwardly toward the rail flange. Contact dimples or pads are contained on the underside of each wing at its distal end and are adapted to reside in holding contact against the flange when the base section of the clamp is secured to the bracket. Any lateral upward displacement of the rail toward the arm such as that produced by rust or the like, causes the wings to deflect upwardly until such time as the base flange of the guide rail contacts the distal end of the arm whereupon a line of contact is established across the width of the arm and the effective stiffness of the clip increases. Further upward displacement of the rail beneath the clip, as produced by random seismic induced loads or other similarly high induced loads, will cause the line of contact between the rail and the arm to move inwardly toward the base section whereupon the effective stiffness of the clip increases as the distance between the line of contact and the base section decreases.

BRIEF DESCRIPTION OF THE DRAWING

For a further understanding of these and other objects of the invention, reference will be made to the following detailed description of the invention which is to be read in connection with the accompanying drawing, wherein.

DETAILED DESCRIPTION OF THE INVENTION

Figure 1:
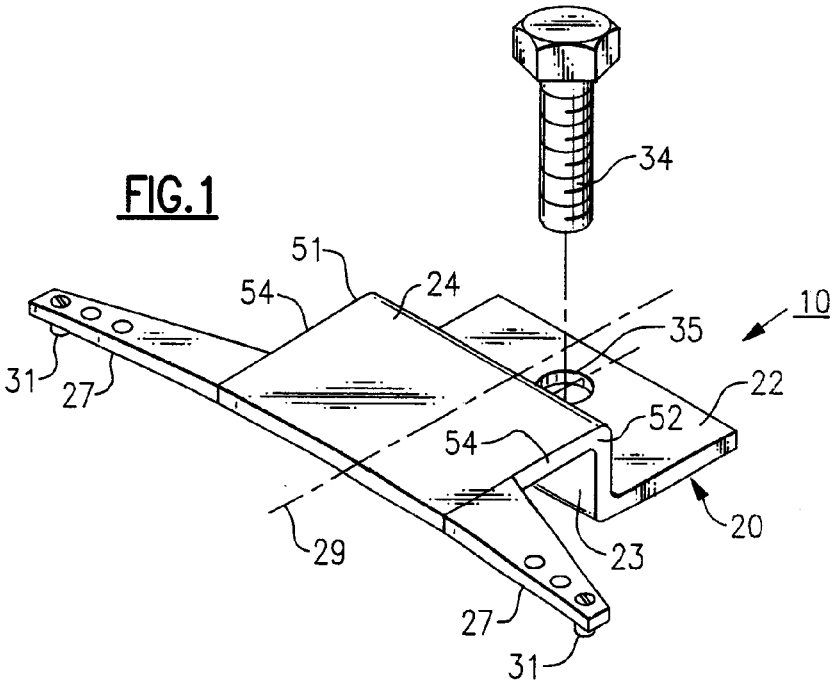
FIG. 1 is a perspective view illustrating an elevator rail clip embodying the teachings of the present invention.
Figure 2:
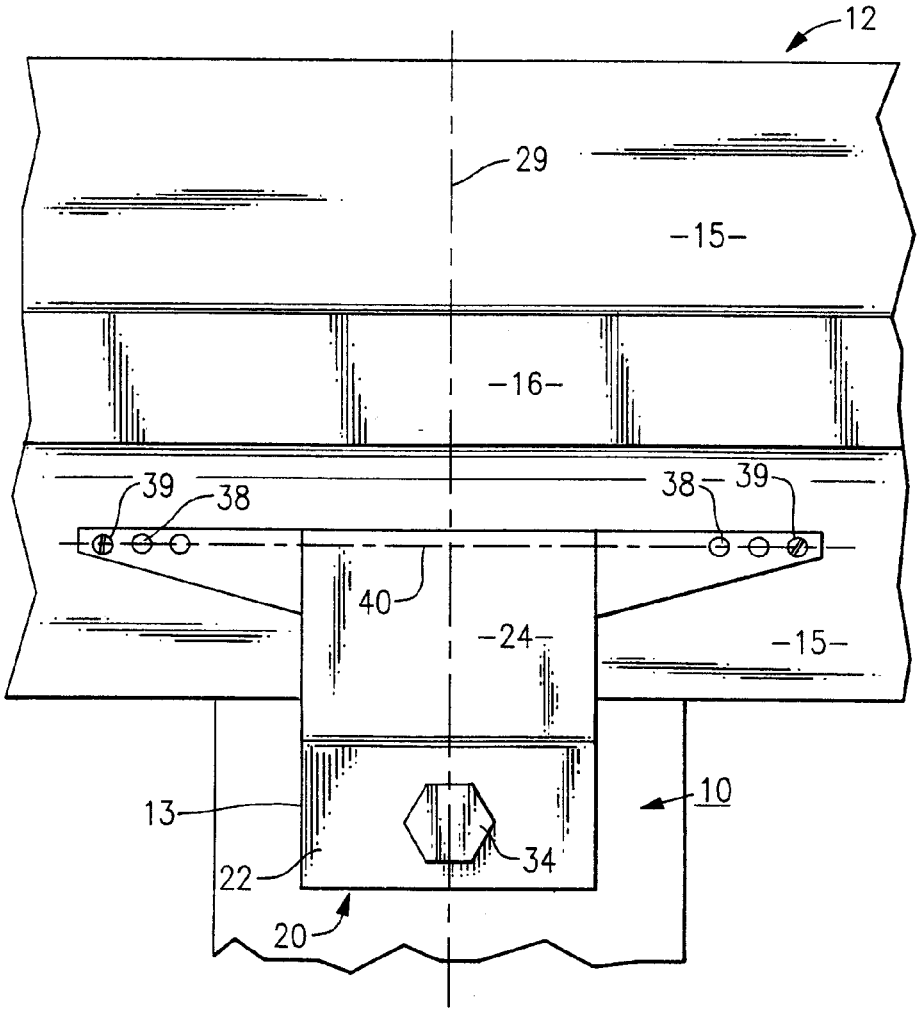
FIG. 2 is a top view showing the clip attached to a support bracket and being mounted in engagement with an elevator guide rail section.

Referring initially to FIGS. 1 and 2, there is illustrated a rail clip, generally referenced 10, that is ideally suited for securing an elevator guide rail section 12 to underlying support brackets 13. As noted above, the typical guide rail presently employed in many elevator systems has a T-shaped cross sectional configuration and includes a base flange 15 and a centrally positioned web or blade 16 that runs longitudinally along the length of the flange. The elevator guide rail sections are aligned vertically end to end in assembly. As is well known, the elevator cab and the associated counterweight unit are each arranged to move freely along a pair of spaced apart rails upon rollers or guide shoes which ride along the blade portion of each rail.

Each rail section is attached to a plurality of support brackets using a number of rail clips. As will be explained in greater detail below, each clip exhibits an initial linear response that is soft enough to provide for longitudinal movement of the rail section and to accommodate for variances in tolerances and the build-up of rust between the bottom of the rail and the top of the supporting bracket. The effective stiffness of the clip, however, increases non-linearly as the lateral movement of the rail beneath the clip increases beyond a predetermined point.

The present clip 10, as illustrated in FIGS. 1 and 2, includes a base plate 22 that is adapted to set upon a support bracket 13 adjacent to the base flange 15 of a guide rail section 12. A second end plate 23 extends along one end of the base plate and rises perpendicularly to a desired height above the base plate. An arm 24 is mounted along the top edge of the end plate and extends outwardly over the base flange of the guide rail section. The arm is a flat member that is generally mounted parallel with the base plate. Preferably, the base plate, the side plate, and the extended arm are integrally formed to create a Z-shaped member, generally referenced 20, that is symmetrical about a central axis 29. A bolt receiving hole 35 is provided in the base plate which is centered upon the axis 29. In assembly, a bolt 34 is passed through the hole and secured in the underlying support bracket. The hole 34 can be circular as shown, or slotted to allow for some adjustment of the clip in assembly.

A pair of wings 27—27 are mounted upon the opposed side walls 54 of the extended arm 24. The wings are generally mounted in perpendicular alignment with the axis 29 of the clip. The root 25 of each wing extends back from the distal end 26 of the arm, some distance toward the proximal end of the arm so that the length of each root is about one-half the length of the arm. The root length may, however, be of greater or lesser length without departing from the teachings of the present invention. The width of each wing tapers downwardly from the root section toward the wing tip and also slopes downwardly from the root toward the tip so that each wing has a negative dihedral, much like the wings of many airplanes.

As best illustrated in FIG. 2, each wing, in assembly, extends longitudinally along the base flange 15 of the rail section in generally parallel alignment with the rail blade 16. A contact pad 31 is located on the underside of each wing at the tip thereof and serves as the point that initially contacts the base flange of the rail section. The contact pad may be a simple dimple shaped protrusion that is integrally formed with the wing, or, as illustrated, may be a removable pad that is secured to the wing by means of a threaded fastener 39. A series of receiving holes 38 for receiving the threaded fastener are located along the leading edge of each wing that allows the contact pads to selectively reposition along the length of each wing. The holes are located along a common axis 40 that is perpendicular to the central axis 29 of the clip. The wings 27 may be integrally joined to arm 24 of the clip and thus the entire clip fabricated from a single piece of material, such as steel, having a desired modulus of elasticity. Alternatively, each wing may be fabricated separately from a material that has a different modulus of elasticity and/or a difference in wing thickness then that of the Z-shaped supporting member and is attached to the arm using well known joining techniques.

Figure 3:
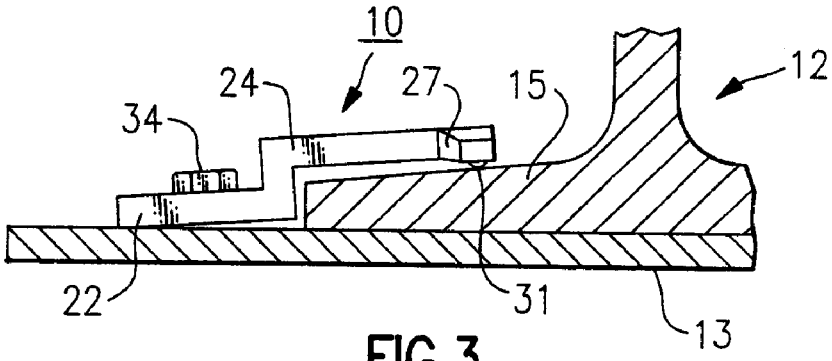
FIGS. 3–6 are side elevations illustrating the rail clip engaging a rail section under varying load conditions.

FIG. 3 depicts the position of the clip 10 prior to tightening the base plate down against the underlying support bracket. At this time, the contact pads 31 of the wings 27 are resting upon the top of the guide rail flange 15 and the base plate 22 is held in a canted position upon the supported bracket 13.

Figure 4:
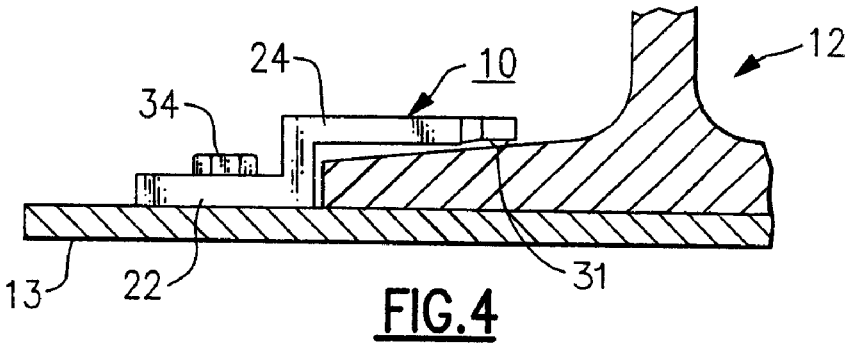

As illustrated in FIG. 4, tightening the base plate 22 of the Z-shaped support member 20 down into support bracket 13 causes the wings to flex upwardly to apply an initial holding force upon the rail flange. The initial holding force is dependent upon the effective stiffness of the wings and the downward slope of the wings and is predetermined to provide for the necessary longitudinal movement of the rail.

As in most elevator systems, a rust build up 42 can build up over time between the bottom of the rail sections and the support bracket. As the radial displacement between the wings and the support bracket increases, the wings will continue to flex upwardly, however, the effective stiffness of the clip remains within a range so that the rail flange can still move longitudinally beneath the clip.

Figure 5:
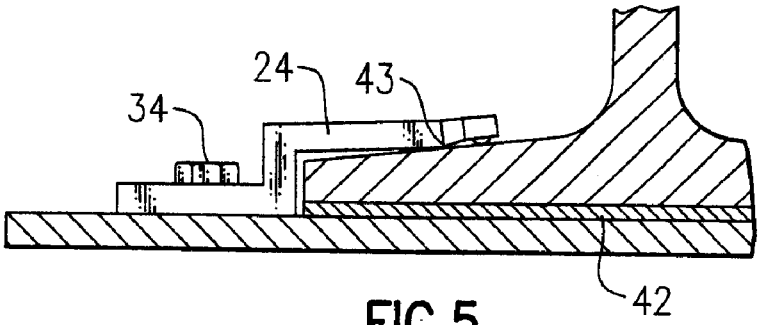

The wings continue to respond linearly as the lateral displacement increases until such time as the flange comes in contact with the distal end of the arm 24 along a line of contact depicted at 43. This condition is illustrated in FIG. 5. Accordingly, the effective stiffness is moved form the wings to the extended arm, and as will be explained in greater detail below, the effective stiffness of the clip at this time increases.

Figure 6:
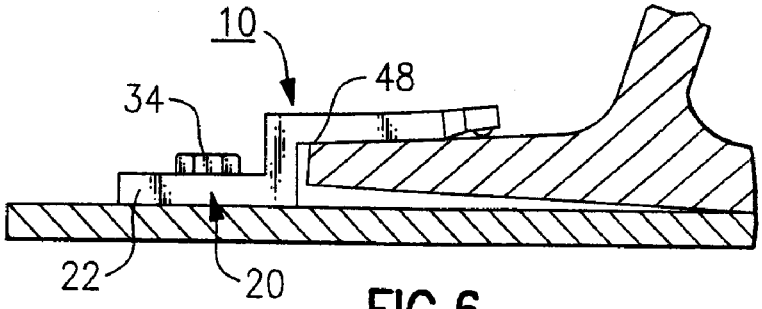

The effective stiffness of the clip increases as the line of contact between the clip and the rail moves inwardly toward the anchor bolt. In the event the elevator system experiences a seismic event, the lateral displacement of the clip can be increased by high random vibrator forces, as illustrated in FIG. 6. The line of contact at this time has moved inwardly toward the proximal end of the extended arm at point 48.

Figure 7:
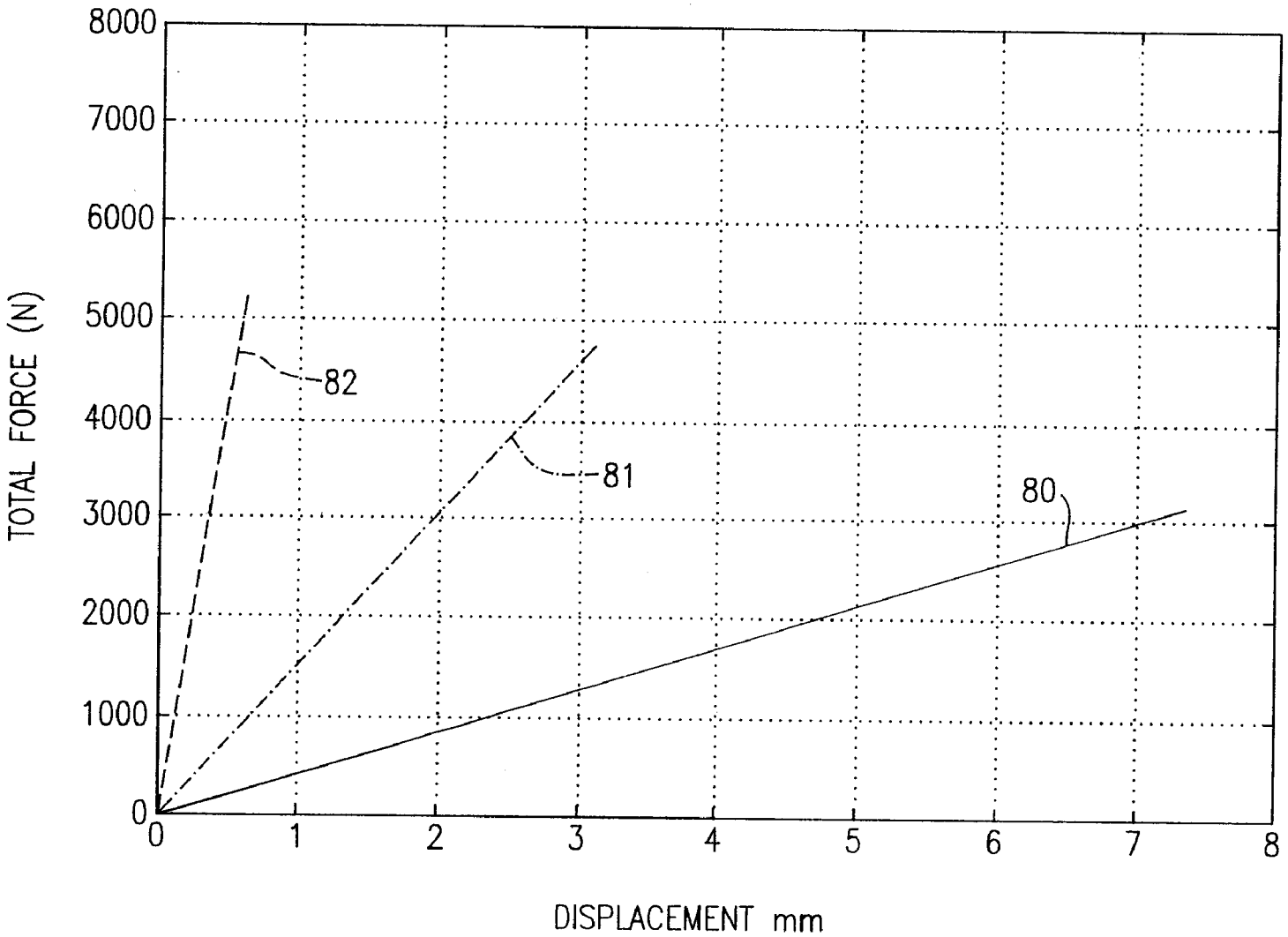
FIG. 7 is a diagram showing the effective stiffness of the clip at varying contact points.

FIG. 7 is a graphic representation showing the effective stiffness of the clip at the three noted contact sites 31, 43 and 48. Curve 80 identifies the effective stiffness of the clip when the distal ends of the two wings are in contact with the base flange of the guide rail as shown in FIG. 4. The clip, at this time, exhibits a soft response which allows for longitudinal movement of the rail sections. Curve 80 is shown as a solid unbroken line and, as can be seen, the effective stiffness of the wing is linear.

Curve 81, which is a dot dash line, depicts the effective stiffness of the clip when the contact has moved to contact line 43 (FIG. 5) at the distal end of the arm. Here again, the response of the clip is relatively linear, however, the effective stiffness as evidenced by the slope of the curve has increased. Curve 82, which is depicted as a dashed line, illustrates the effective stiffness of the clip when the contact has moved to contact line 48 close to the proximal end of the arm as shown in FIG. 6. At this time, the contact has moved closer to the center of the tie down bolt and the effective stiffness of the clip as experienced by the slope of the curve has increased dramatically. As clearly illustrated, the effective stiffness of the clip increases as the wings deflect upwardly and as the contact point moves from the wings to various points along the arm.

Figure 8:
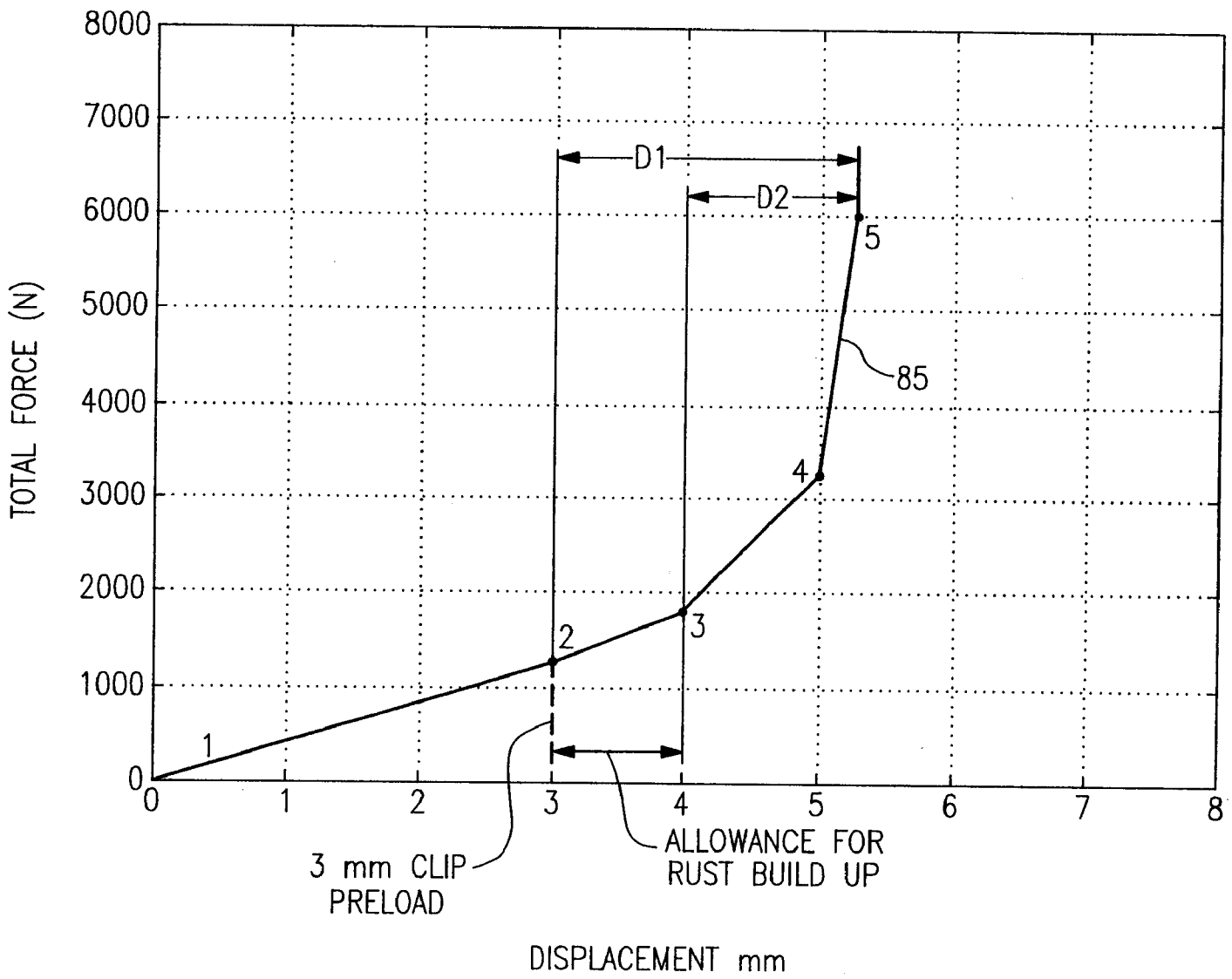
FIG. 8 shows the overall response curve of the clip as the contact point changes due to the lateral displacement of a guide rail section secured by clip changes.

FIG. 8 is a graphic illustration of the effective stiffness of the present clip as the contact point moves from the wings to the extended arm 27 and then back along the arm toward the tie down bolt 35. Initially, the effective stiffness increases linear from point 1 to point 2. As rust builds up under the base flange of the rail, the wings continue to deflect due to an increase in the lateral displacement of the wings. This occurs between points 2 and 3 after which the rail flange moves into contact along the line of contact 43 (FIG. 5). The effective stiffness of the clip now increases between points 3 and 4. In the event the elevator system experiences high induced loads such as those produced by a seismic event, the lateral displacement between the arm and the support bracket will increase as illustrated in FIG. 6 and the line of contact is moved back from point 43 to point 48. Accordingly, the effective stiffness of clip is now more pronounced as depicted by the overall response curve 85 and is high enough to meet the code requirement relating to seismic applications.

While the present invention has been particularly shown and described with reference to the preferred mode as illustrated in the drawing, it will be understood by one skilled in the art that various changes in detail may be effected therein without departing from the spirit and scope of the invention as defined by the claims.

What is claimed is:

1. A rail clip generally arranged symmetrically about a central axis, the effective stiffness of the clip increasing in response to an increase in the lateral displacement of a rail secured by said clip, wherein said rail clip includes:

a Z-shaped member having a base plate and a raised outwardly extended arm that is in parallel alignment with said base plate, and a wing extending outwardly from each side of said arm, each wing having a root that is attached to a side wall of said arm and being generally perpendicularly aligned with said axis of the clip, said wings sloping downwardly from said arm so that the wings initially contact a rail that is being clamped by said clip.

2. The rail clip of claim 1 that further includes a fastening means for securing the base plate to a support bracket upon which the rail is seated.

3. The rail clip of claim 1 wherein the Z-shaped member and the wings are integrally formed of the same material.

4. The rail clip of claim 3 wherein the Z-shaped member and the wings are formed of steel.

5. The rail clip of claim 1 wherein each wing has a negative dihedral and each wing further includes a contact pad on its underside at the wing tip.

6. The rail clip of claim 5 wherein each contact pad is a dimple shaped protrusion that is integral with the wing.

7. The rail clip of claim 5 wherein said contact pads include means for selectively mounting each pad at varying distances from the axis of the clip.

8. A rail clip for securing a T-shaped elevator guide rail to a support bracket, said rail having a mounting flange and a raised web perpendicularly mounted upon the flange that extends longitudinally along the flange, said rail clip including an L-shaped base section having a horizontally disposed base plate and a vertically disposed raised wall, mounting means for securing the base plate to said support bracket adjacent to the mounting flange of a guide rail, an outwardly disposed arm mounted along the top edge of said raised wall that is adapted to pass over the mounting flange of a guide rails, a pair of wings mounted upon opposed side walls of said extended arm, each wing extending outwardly from said arm an equal distance whereby said wings are positionable in parallel alignment with the web of said guide rail, each wing further including a contact pad mounted at its tip on the underside thereof, said wings having a negative dihedral so that the contact pad of each wing moves into initial holding contact against the flange of the guide rail when the base plate is secured to the support bracket, and said wings having an effective stiffness such that the wings deflect upwardly as the lateral displacement between the support bracket increases to a predetermined displacement at which time the contact between the clip and the flange is transferred to the distal end of the extended arm.

9. The rail clip of claim 8 that further includes fastener means for securing the base plate of said clip to a support bracket so that the wings are brought into holding contact with the flange of a rail seated upon said bracket adjacent said clip.

10. The rail clip of claim 8 wherein said arm has a geometry such that the line of contact between the arm and the rail moves toward the proximal end of said arm as the lateral displacement increases to further increase the effective stiffness of the clip.

11. The rail clip of claim 8 whereby the L-shaped member, the extended arm and the wings are integrally formed of steel.

12. The rail clip of claim 8 wherein said wings are fabricated of a different material than said arm and the thickness or material of said wings vary from that of the arm.

* * * * *